US006112532A

United States Patent [19]

Bakken

[11] Patent Number: 6,112,532

[45] Date of Patent: Sep. 5, 2000

[54] REFRIGERATION SYSTEM WITH CLOSED CIRCUIT CIRCULATION

[75] Inventor: Knut Bakken, Askim, Norway

[73] Assignee: Norild AS, Askim, Norway

[21] Appl. No.: 09/331,955

[22] PCT Filed: Jan. 8, 1998

[86] PCT No.: PCT/NO98/00004

§ 371 Date: Jun. 30, 1999

§ 102(e) Date: Jun. 30, 1999

[87] PCT Pub. No.: WO98/30847

PCT Pub. Date: Jul. 16, 1998

[30] Foreign Application Priority Data

Jan. 8, 1997 [NO] Norway ..... 19970066

[51] Int. Cl.[7] ..... F25B 41/00

[52] U.S. Cl. ..... 62/174; 62/149; 62/503

[58] Field of Search ..... 62/174, 149, 503, 62/475, 126, 129, 185

[56] References Cited

U.S. PATENT DOCUMENTS

| | | | |
|---|---|---|---|
| 4,175,400 | 11/1979 | Edwards et al. | 62/174 |
| 5,042,262 | 8/1991 | Gyger et al. . | |
| 5,245,836 | 9/1993 | Lorentzen et al. | 62/174 |
| 6,012,300 | 1/2000 | Tomatsu et al | 62/222 |

FOREIGN PATENT DOCUMENTS

| | | |
|---|---|---|
| 30 30 754 | 2/1982 | Germany . |
| WO 93/06423 | 4/1993 | WIPO . |
| WO 94/14016 | 6/1994 | WIPO . |
| WO 96/20379 | 7/1996 | WIPO . |

*Primary Examiner*—William Doerrler
*Assistant Examiner*—Marc Norman
*Attorney, Agent, or Firm*—Young & Thompson

[57] ABSTRACT

A refrigeration system having a closed circulating circuit filled with a refrigerant which on evaporation expands and gives rise to an increase in pressure in the whole or in parts of the circulating circuit, and which at ambient temperature has a saturation pressure that is higher than the maximum working pressure in the refrigeration circuit. A refrigeration of this kind may, for example, be carbon dioxide. By allowing vaporized refrigerant to condense against the surface of the refrigerant in liquid phase, contained in a container that is insulated and has adapted size and adapted liquid level, the pressure in the circulating circuit can be maintained below the maximum working pressure of the refrigeration circuit. Thus undesirable build-up of pressure in the event of, e.g., a period of inoperation or breakdown, is prevented, and the circulating circuit of the refrigeration system can be designed and made for a pressure which is below the saturation pressure at ambient temperature of the refrigerant used, and the refrigeration system can be made using conventional or at least virtually conventional elements, whereby the total system costs are reduced considerably in relation to a total system which is built to withstand higher pressure, e.g., the saturation pressure at room temperature of the refrigerant. Starting up after, e.g., a period of inoperation or breakdown is secured with valves which provide a controlled fall in pressure in an insulated container after an increase in pressure in the same container exceeding the maximum working pressure of the circuits.

10 Claims, 4 Drawing Sheets

REFRIGERATION SYSTEM WITH CLOSED CIRCUIT CIRCULATION

The present invention relates to a refrigeration system having a closed circulating circuit filled with a refrigerant intended for heat transfer, which refrigerant at atmospheric pressure has a saturation pressure that is higher than maximum working pressure in the circulating circuit, which refrigeration system consists at least of one or more evaporators or heat exchangers, equipment for circulation of the refrigerant and one or more condensers, and also at least one container for the refrigerant in connection with the refrigeration circuit.

In recent years concern for the environment has brought about a change in the use of refrigerants in refrigeration systems/heat pumps for, e.g. refrigerated cabinets in grocery shops, air cooling. refrigerated transport and refrigerated storage rooms. This change is primarily related to the fact that the vast majority of synthetic refrigerants which were used earlier (e.g., chlorofluorocarbons), if released, led to a depletion of the ozone layer in the stratosphere, and thus also increased ultraviolet radiation. The use and thus the emissions of these refrigerants have now been regulated through international agreements. and stringent national and international requirements mean that a great many synthetic refrigerants (CFC refrigerants) can no longer be used.

To compare the different refrigerants and their environmental impact, it is essential to examine their ozone depletion potential (ODP) and greenhouse warming-up potential (GWP). An overview of refrigerants that have conventionally been used in refrigeration systems in e.g., grocery shops, is as follows:

| Refrigerants | Not available after: | Ozone depletion potential (ODP), (CFC11 = 1) | Greenhouse warming-up potential (GWP) (100 years), (CO2 = 1) |
|---|---|---|---|
| CFC - 12 | 1995 | 1 | 7100 |
| CFC - 502 | 1995 | 0.32 | 4300 |
| HCFC - 22 | 2014 | 0.055 | 1600 |

Halocarbons may be used to replace these refrigerants. These do not destroy the ozone layer, but still contribute to the greenhouse effect. Examples of some such refrigerants are:

| Refrigerants: | Replace: | Producer | Based on (% age) (other comm.) | Evap. temp. Temp. fluct. | Ozone depletion potential (ODP) | Gr.house warming-up pot. (GWP) |
|---|---|---|---|---|---|---|
| HP 62<br>HCF 404A<br>R-404A | CFC 502<br>HCFC 22 | DuPont | HFC134a 4%<br>HFC125 44%<br>HFC143a 52% | −46.1° C.<br>0.7 | 0 | 2650 |
| Klea 60<br>R-407B | CFC 502<br>HCFC 22 | ICI | HFC32 20%<br>HFC125 40%<br>HFC134a 40% | −42.2° C.<br>6.6 | 0 | 1575 |
| Klea 61<br>R-407B | CFC 502<br>HCFC 22 | ICI | HFC32 10%<br>HFC125 70%<br>HFC134a 20% | −45.1° C.<br>4.4 | 0 | 2290 |
| Genetron<br>AZ-50<br>R-507 | CFC 502<br>HCFC 22 | Allied Signal | HFC125 50%<br>HFC143a 50%<br>(Azeotrope) | −45.8° C. | 0 | 2720 |
| HCF 134a<br>R-134A | CFC12 | All producers | | −26.5° C. | 0 | 1200 |

In addition, natural refrigerants such as, e.g., ammonia ($NH_3$), carbon dioxide ($CO_2$) and propane ($C_3H_8$) can be used. These refrigerants have virtually no ozone depletion potential and, with the exception of carbon dioxide, they have almost no greenhouse warming-up potential. However, the use of $CO_2$ as a refrigerant cannot be looked upon as a contribution to the greenhouse effect as reutilisation is assumed.

Of these naturally occurring refrigerants, ammonia and carbon dioxide are considered to be the most suitable and environmentally safe refrigerants that can be used. When using ammonia as a refrigerant, known technology is employed which is adapted to the individual use and system, but this medium is toxic and under certain circumstances it is flammable. This means that a brine should be used as a secondary agent for the individual applications in the refrigeration circuit. The same applies when using propane as a refrigerant.

The use of carbon dioxide as a refrigerant is previously known, but when synthetic refrigerants were introduced, the use of carbon dioxide for this purpose was greatly reduced, a fact also attributable to a number of drawbacks connected to carbon dioxide as a refrigerant.

These drawbacks include the fact that the temperature gap between the critical temperature and the so-called triple point is relatively small compared with traditional refrigerants. This means that when $CO_2$ is used in an ordinary refrigeration process, the carbon dioxide will for the most part be used in a temperature range of from −50° C. (evaporation) to about −5° C. (condensation) with a reasonable coefficient of performance. This means that carbon dioxide is rather inflexible with respect to different applications (temperature levels). The individual system must therefore be adapted to the individual application.

A further drawback when using $CO_2$ as refrigerant compared with conventional refrigeration systems, is associated with the rise in pressure which occurs when the temperature of the refrigerant passes from working temperature to ambient temperature. At room temperature the saturation pressure of carbon dioxide is about 50 to 60 bar, and this is considerably higher than the working pressure in a conventional refrigeration system. This means that in the event of a breakdown, the saturation pressure will rise in the circulating circuit as the temperature rises, and if the circuit is to be capable of (withstanding saturation pressure at ambient temperature, the individual components in the refrigeration circuit must be designed for this high pressure, which means a sharp increase in costs compared with conventional refrigeration systems.

In connection with this problem, it is previously known from. e.g., U.S. Pat. No. 5.042.262 that a refrigeration system using carbon dioxide as refrigerant, when the system is not operating, will maintain a pressure in the refrigeration circuit of less than about 17 bar by either a mechanical cooling of the refrigerant in the circulating circuit or by a pressure relief means which releases the vaporised carbon dioxide into the environment in order to adjust the pressure. In large systems, a mechanical cooling of the whole of or parts of the refrigeration circuit to reduce the pressure when the system is not in operation will result in a considerable rise in installation and maintenance costs. If the refrigerant is released through a pressure relief valve in order to maintain the pressure in the refrigeration circuit below the maximum working pressure, this will involve adding a new refrigerant when starting up the system, which involves costs, in addition to the indirect cost of the refrigeration system being inoperative pending a refill of refrigerant.

Furthermore, from U.S. Pat. No. 4,693,737 it is known to use carbon dioxide as brine in a secondary circuit of a refrigeration system. In this case, the refrigerant in the secondary circuit is stored in a large tank in liquid form and the individual applications in the circuit are cooled by evaporation of liquid $CO_2$. The tank is kept cooled by the primary circuit and on the return of vaporised $CO_2$ in the secondary circuit it is condensed in the storage container. If the system is not in operation, the vaporised $CO_2$ will condense against the surface of the contents in the container, but after some time the condensation will abate, with a subsequent increase in pressure which is limited by releasing vaporised $CO_2$ from the secondary circuit.

Moreover, U.S. Pat. No. 4,986,086 makes known a refrigeration system where a refrigerant, preferably carbon dioxide, is used, where the recommended maximum working pressure is about 35 bar. Evaporation which results in additional pressure is controlled by releasing $CO_2$, from the system into the environment. This ventilation takes place chiefly from a container in the system which can accommodate a higher pressure than the working pressure in the rest of the refrigeration system.

Another two-stage cooling process using carbon dioxide in the secondary circuit is described in GB 2 258 298 A. The secondary circuit in this system is described as having a maximum working pressure of about 34 bar, which is said to be higher than normal in a refrigeration system of this kind. This calls for a special design of the various elements in the refrigeration circuit in order to handle this high pressure. In the event of a breakdown or a period of non-operation, it is not stated how an additional increase in pressure as a result of the effect of temperature from the surroundings is dealt with.

To maintain the temperature, and thus the pressure, in a container of carbon dioxide at a relatively low level when, e.g., transporting carbon dioxide, it is known from WO 88/04007 to insulate a container that is to hold carbon dioxide. In addition to insulation, it is known from WO 93/23117 to provide a separate refrigeration unit in connection with a container that is to hold carbon dioxide with a view to maintaining the temperature, and thus the pressure, at a favourable level in relation to the maximum working temperature in the storage container.

The use of carbon dioxide in a single application in connection with a refrigeration unit, where carbon dioxide is contained in an insulated tank, is also described in U.S. Pat. No. 4,129,432 and U.S. Pat. No. 4,407,144. In these systems, carbon dioxide is released into the environment after evaporation.

In the Nordic Refrigeration Journal ("Kulde-Skandinavia") No. 5/96, there is a discussion on pages 25 to 28 of the disadvantages and advantages which arise when using carbon dioxide as a refrigerant, and it is pointed out that carbon dioxide in refrigeration systems requires the system to have been built for especially high pressure, e.g., 120 to 140 bar, and even for a low temperature operation with a design pressure of 25 to 40 bar, it is necessary to install supplementary equipment in order to cope with an inoperative situation. Similar problems are also presented in the article on pages 34 to 37 and page 60 in the Nordic Refrigeration Journal ("Kulde-Skandinavia"), No. 4/96. Special attention is directed to the situation that arises when the system is not in operation, where the saturation pressure in the refrigerant exceeds maximum working pressure.

SE 9202969 describes a cooling system where a container in a circulating circuit is located between a first and a second pressure reducing means. The purpose of the is container is to collect coolant in order to pass this into the screw compressor between the inlet and outlet of the compressor, in order to cool the screw compressor. Furthermore, a valve is installed which controls the flow of the gaseous coolant through the duct from the container to the screw compressor. A container is placed in the cooling circuit, but the pressure in parts of the cooling circuit is reduced further after the container by pressure reducing means and if the system stops operating, the coolant will be able to flow back to the container as it assumes ambient temperature and the pressure eventually increases, whereupon gaseous coolant will be able to condense against the surface of the liquid coolant in the container. However, this will not take place immediately from the parts of the system where the pressure is lower. i.e., after the pressure reduction valve. Furthermore, there is no disclosure of specific distinctive features of the container or the location of the pressure regulating means in connection therewith which enable the container to be a receptacle for vaporised coolant with the intention that this should to the greatest extent possible be condensed against the surface of the coolant in the container to be subsequently a storage container for coolant in a system that is not in operation.

In DK 159894B, as in the aforementioned Swedish patent publication, a container is also located in a cooling circuit. The container is divided into two chambers and the purpose seems to be that a recirculation number greater than 1 is obtained, whereby the liquid and vapour circulate together in the cooling circuit, which gives better heat transfer in the evaporator. A valve system is provided in connection with the container, which helps to maintain the liquid levels in the separate chambers at the desired level, and also to contribute to a pressure equalisation between the chambers. Nor in this patent publication is the container designed for receiving coolant in vapour form in order that this should subsequently be condensed against the free surface of the coolant, and the container is thus not provided with the means which are necessary if the container is to have this function.

One of the objects of the invention is to overcome the drawbacks that are associated with the prior art, and the refrigeration system is characterised according to the invention in that there is provided at least one insulated tank for the refrigerant in connection with the refrigeration circuit, which container is sufficiently proportioned and insulated and sufficiently filled with refrigerant in liquid phase so that at least parts of the vaporised refrigerant in the refrigeration circuit condense against the liquid surface in the container, and that the saturation pressure in the circuit essentially does not exceed maximum working pressure of the whole of or parts of the refrigeration circuit.

Additional embodiments of the refrigeration system are set forth in the attached patent claims and in the following description with reference to appended drawings.

The present invention provides a solution which enables a refrigeration system to be built primarily of conventional elements which require a maximum working pressure that is below the saturation pressure of the refrigerant used at ambient temperature. This will be the case, for example, when using carbon dioxide as refrigerant in most instances, as carbon dioxide at normal room temperature has a saturation pressure in the range of 50 to 60 bar which is higher than the normal maximum working pressure for a refrigeration system consisting of conventional elements. Furthermore, the present invention provides a solution where vaporised refrigerant, which will result in an increase in pressure in the refrigeration system, is not released through the pressure relief valve if the system is inoperative and affected by the temperature from the surroundings. This is to obviate the necessity of refilling the refrigeration system with refrigerant before it can be restarted. An ideal situation in this case would be that the refrigerant, in the event of a breakdown, is practically completely received in the container without the pressure exceeding maximum working pressure, so that the refrigeration system can be restarted without adding fresh refrigerant even if during the breakdown the refrigerant has reached a temperature that is considerably closer to the ambient temperature of the system than the working temperature of the refrigerant. Furthermore, the concept of the present invention will limit the build-up of pressure in the event of a breakdown, so that if the system is restarted after a relatively short time, this will happen without the refrigerant being released, or without the saturation pressure of the refrigerant having exceeded the maximum working pressure in the system.

By arranging in the refrigeration circuit an insulated container which is adapted as regards size, insulation and rate of admission of the refrigerant in liquid phase, it will be possible, in the event of a breakdown, to maintain the temperature in the container at a level such that vaporised refrigerant returning to the container will condense against the surface of the liquid phase in the container and thus reduce the rise in pressure owing to evaporation in the circulating circuit. By designing the container so that wall thickness, insulation, magnitude of the liquid surface and size of the tank in other respects help to keep the temperature in the tank stable even in the event of a breakdown, it will be possible to obtain considerably lower increase of pressure per time unit in the circuit than by using an uninsulated container of the standard type. Furthermore, it will be possible to construct the container so that the whole of or parts of the quantity of fluid in the circulating circuit condense in the container before the saturation pressure exceeds maximum working pressure in the circuit if the system is not operating.

As a result, a refrigeration system, for example, for grocery shops, may be produced using conventional elements for moderate working pressure which is considerably lower than the saturation pressure of the refrigerant at ambient temperature. In the event of a breakdown, according to the invention, it will be possible to condense vaporised refrigerant in the insulated container, thereby maintaining a pressure in the refrigeration system which does not exceed maximum working pressure.

If, in addition, there are provided manual or automatic valves for closing the connections in/out of the container with a bypass of the valves, where there is provided a check valve, it will be possible to allow vaporised refrigerant to return to the insulated container and condense, in order thus to maintain a pressure in the circulating circuit which is lower than maximum working pressure. Safety valves may also be provided which, in the event of an undesirable build-up of pressure in the circulating circuit, release vaporised refrigerant into the surroundings.

If the container is designed for a higher pressure, below, equal to or above the saturation pressure of the refrigerant, all of or parts of the refrigerant can be stored in the container after condensation for varying periods of time or indefinitely.

Starting up after, e.g., a period of inoperation or a breakdown, is secured by valves which give a controlled fall in pressure in the insulated container after a rise in pressure in the same container above the maximum working pressure in the circuits.

The invention will now be described in more detail with reference to appended FIGS. 1 to 4 which illustrate different embodiments of the inventive concept.

FIG. 1 describes an ordinary refrigeration system according to the invention where an insulated tank is used as a low pressure receiver.

Figure 1:
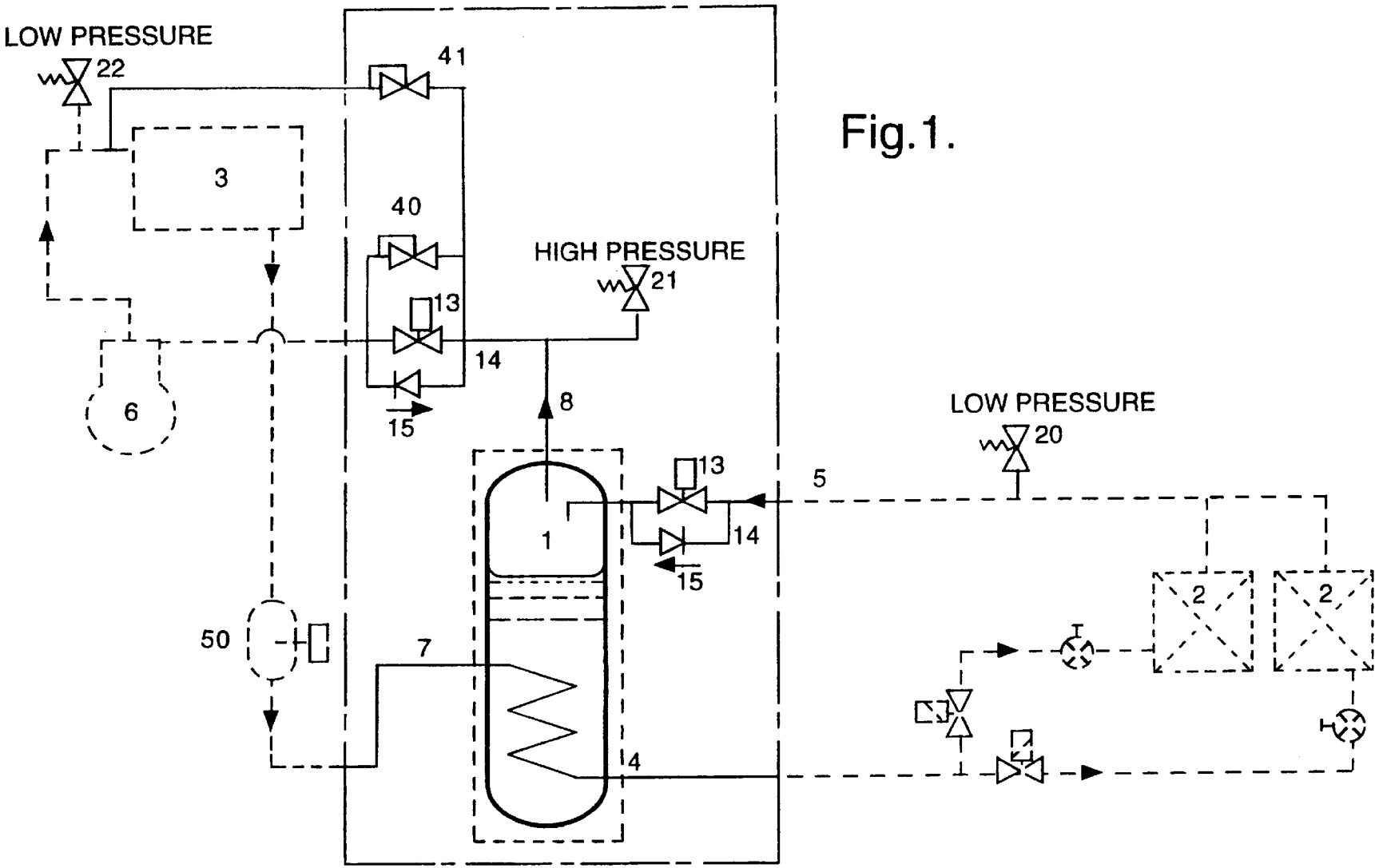

FIG. 1 shows a refrigeration system having an insulated container 1 for the refrigerant in liquid phase and gas phase, and a circuit with intake 4 of the refrigerant in liquid phase, to evaporators 2 and then via a return pipe 5 to an insulated tank 1. From the tank 1 vaporised refrigerant then passes to the compressor 6 and then to the condenser 3 and then back via intake 7 to intake 4 via a heat exchanger in the insulated tank 1. On each of the pipe connections where the refrigerant is in the vaporised state there is arranged a safety valve 20 which, in the event of a build-up of pressure in the piping in excess of maximum working pressure, releases vaporised refrigerant into the surroundings. According to the invention, vaporised refrigerant in the return pipe 5 and the intake 8 will be capable of being conveyed back to the insulated tank 1 and, when the refrigeration system is inoperative, the vaporised refrigerant will be able to condense therein against the surface of the refrigerant in liquid form in order thus to maintain the saturation pressure in the refrigerant below the maximum working pressure of the refrigeration circuit without releasing vaporised refrigerant through the pressure relief valves or safety valves 20 to 22. In the event of a breakdown in the system, the valves 13 can be closed manually or automatically, and at bypass 14 there is arranged a check valve 15 which allows vaporised refrigerant to enter the insulated container 1 as the pressure rises in those parts of the refrigeration circuit where the temperature of the refrigerant rises as a result of the ambient temperature around the refrigeration system.

The valves 40 and 41 allow for a controlled fall in pressure in the insulated tank 1 after an increase in pressure in the same tank above the maximum working pressure in the circuits owing to, e.g., a period of inoperation or a breakdown. The controlled fall in pressure is due to the operation of the refrigeration system or direct condensation in the condenser. During the fall in pressure it is important that the tank 50, condenser or associated pipe section have the necessary volume to accumulate condensed liquid during the fall in pressure. Moreover, evaporators 2 which, for example, may be freezer cabinets in a grocery shop or the like, are provided with valves etc. as in a normal conventional refrigeration circuit.

Figure 2:
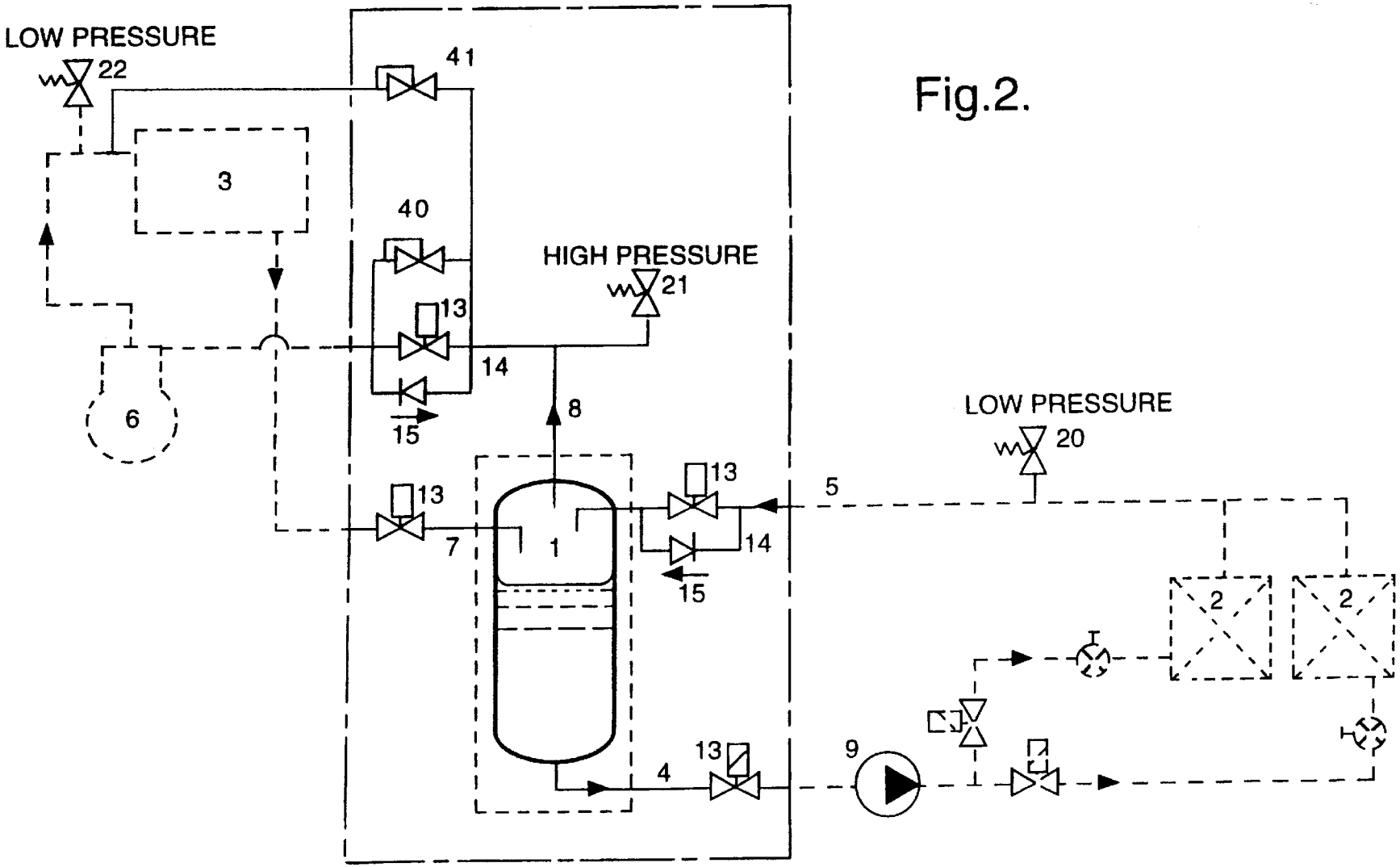
FIG. 2 shows a system where the refrigerant circulates from a fluid container according to the present invention by means of a pump or self-circulation.

FIG. 2 shows a refrigeration system essentially like that in FIG. 1 but where the intake 7 from the condenser 3 to the insulated tank 1 does not pass in a closed circuit with the intake 4 from the insulated tank 1 to evaporators 2. In this case, there is also provided on the intake 4 an automatic or manual valve 13 which can be closed if the refrigeration system breaks down. Moreover, a pump 9 may be provided for liquid transport of the refrigerant; alternatively the system may be based on self-circulation. This refrigeration system is also made in accordance with the inventive concept in that the container 1 is insulated and adapted in size and admission rate so that if the system breaks down, the refrigerant in the refrigeration circuit will be affected by the ambient temperature, whereby an increase in pressure will take place and vaporised refrigerant will be able to return to the insulated tank 1 via the pipes 5 and 8. As the insulated tank 1 is made according to the invention, the vaporised refrigerant will condense in the tank against the surface of the refrigerant in liquid phase and pressure increase in the refrigeration system will be moderated.

Figure 3:
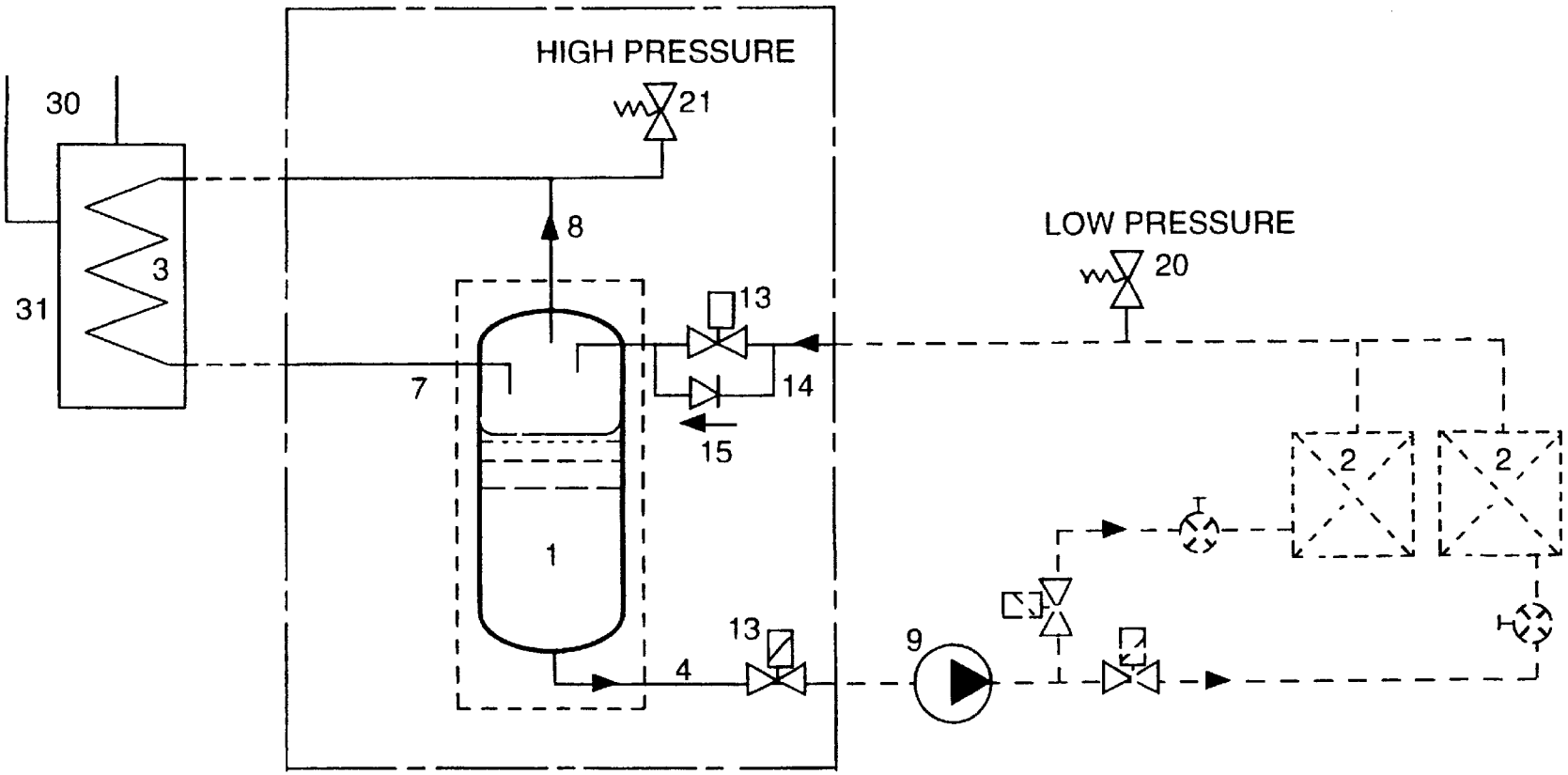
FIG. 3 shows a system similar to that in FIG. 2, where the present invention is used in a secondary circuit.

In FIG. 3 the present invention is used in a part of a secondary refrigeration circuit. In this case, the refrigeration circuit works in connection with a refrigeration system 30 through an evaporator/condenser device 31, 3 where the outflow 8 from the insulated tank 1 circulates through the condenser 3 and returns via the intake 7 to the insulated tank 1. The circuit with evaporators 2 is in other respects the same as that in FIGS. 1 and 2, and in this system too it will be possible, in the event of a breakdown, for vaporised refrigerant to return to the insulated tank 1, whereby according to the invention it condenses against the surface of the refrigerant in liquid phase and the build-up of pressure in the refrigeration system is retarded considerably.

Figure 4:
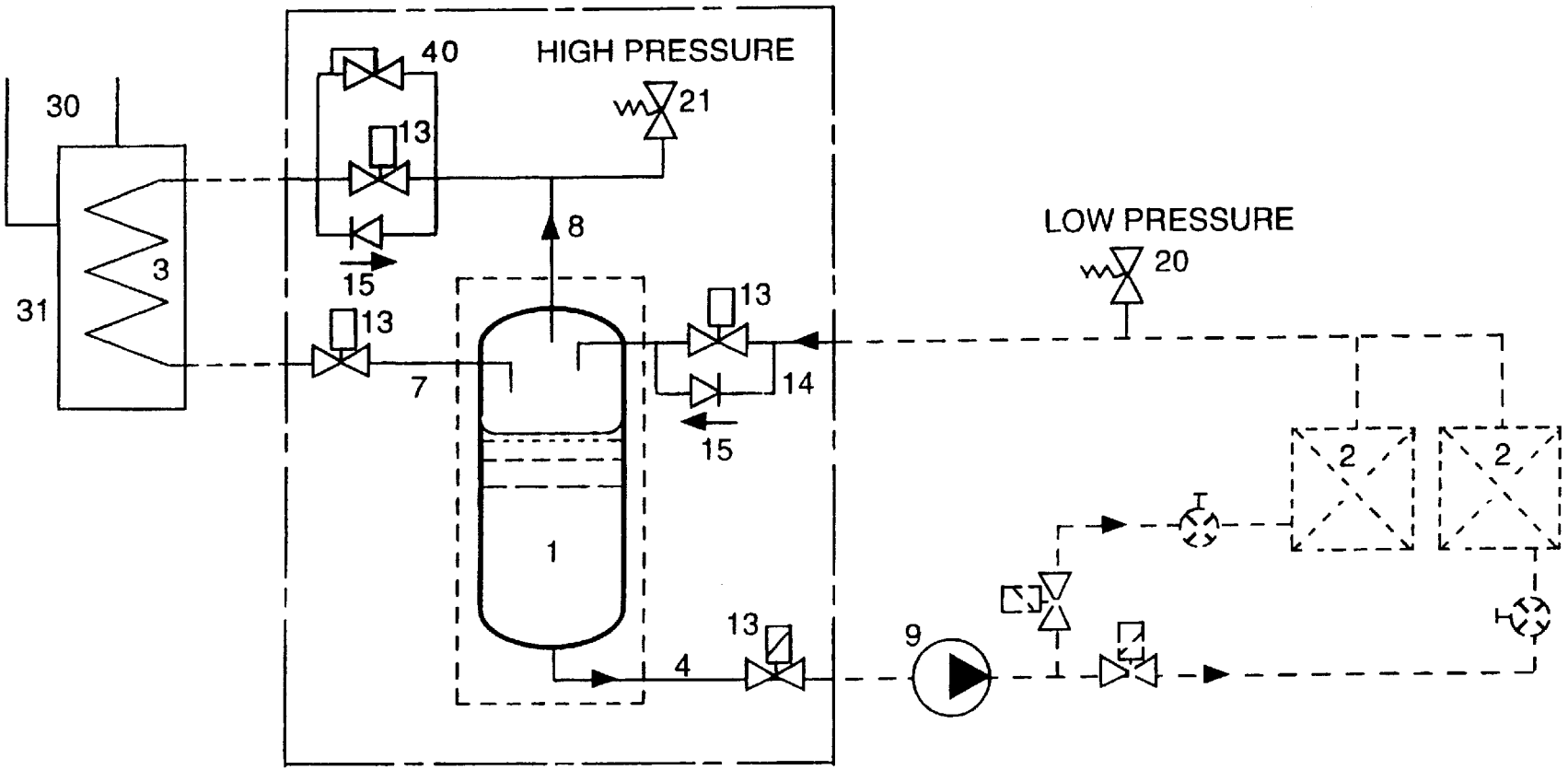
FIG. 4 shows a system similar to that in FIG. 3, where the present invention is used in a secondary circuit, wherein an evaporator/condenser-device may be designed for lower pressure than the saturation pressure of the refrigerant at ambient temperature.

In FIG. 4 the present invention is used in a part of a secondary refrigeration circuit as in FIG. 3. In this case, the refrigeration circuit works in connection with a refrigeration system 30 through an evaporator/condenser device 31, 3 where the outflow 8 from the insulated tank 1 circulates through the condenser 3 and returns via the intake 7 to the insulated tank 1. The valves between 3 and 7, 8 mean that the condenser device 3 can be designed for a lower pressure than the insulated tank 1. The circuit with evaporators 2 is in other respects the same as that in FIGS. 1, 2 and 3, and in this system too it will be possible, in the event of a breakdown, for vaporised refrigerant to return to the insulated tank 1, whereby according to the invention it condenses against the surface of the refrigerant in liquid phase and the build-up of pressure in the refrigeration system is retarded considerably.

The container 1 will thus form a part of the circulating circuit as a low pressure receiver, optionally as a liquid container where the refrigerant is used as a secondary agent.

By also designing the container 1 for a higher pressure and by providing it with the valves 13, 14 and 15 and also the valves 20, 21 and 22 adapted to the dimensioning of respectively the circulation system, container and optionally compressor/condenser, parts of or all of the refrigerant supply can be stored for varying lengths of time or indefinitely.

When the refrigerant evaporates in the applications 2 and later condenses against the cold liquid surface in the tank 1, the relation between the condensation heat and the specific heat of the liquid will be crucial, and by insulating the tank 1 adequately and also ensuring there is a sufficient liquid volume, it will be possible to obtain an increase in pressure in the refrigeration system, for example, in the range of 2 bar per hour or less. Alternatively, all of or parts of the quantity of fluid in the circulating circuit will condense in the container or plurality of containers 1 before the saturation pressure in the refrigeration circuit exceeds maximum working pressure, even when the refrigeration circuit has reached approximately ambient temperature. If the breakdown is prolonged, the temperature in the insulated container 1 will rise so that the pressure here exceeds the maximum working pressure in the refrigeration circuit, but because of the valves 13 and the check valves 15, this rise in pressure will not spread to the rest of the refrigeration system, and if the pressure exceeds the maximum working pressure of the insulated tank, a pressure relief or safety valve 21 in association with the tank, located as shown on the outlet 8 from the tank 1 in FIGS. 1–4, will be able to release vaporised refrigerant and thus control the pressure in the container 1. This involves loss of refrigerant and when starting the refrigeration system after a breakdown, this loss must be replaced by adding fresh refrigerant. However, this situation can be greatly retarded or eliminated by using the present invention, and moreover refrigeration systems for the type of refrigerant discussed in connection with the present application, for example, carbon dioxide, can be designed and constructed for a considerably lower working pressure than the saturation pressure of the vaporised refrigerant at the ambient temperature of the refrigeration system. This reduces the costs of the refrigeration system considerably in that purpose-built elements are largely avoided and in that valves, pipes etc. will only take up a substantially lower load than would be the case if the system were to be designed for the saturation pressure of the refrigerant at ambient temperature.

What is claimed is:

1. A refrigeration system having a closed circulating circuit filled with a refrigerant intended for heat transfer, which refrigerant at ambient temperature has a saturation pressure that is higher than the maximum working pressure in the circulating circuit, which refrigeration system consists at least of one or more evaporators or heat exchangers, equipment for the circulation of the refrigerant and one or more condensers, and also at least one container for the refrigerant in connection with the refrigeration circuit, characterised in that the container (1) is insulated and is designed for a pressure, less than, equal to or higher than the saturation pressure of the refrigerant at ambient temperature, which container (1) is sufficiently filled with refrigerant in liquid phase for at least parts of the vaporised refrigerant in the refrigeration circuit to condense against the liquid surface in the container (1), and that in association with the container there is provided at least one pressure relief valve (21) which releases refrigerant when the saturation pressure exceeds the maximum working pressure of the tank.

2. A refrigeration system having a closed circulating circuit according to claim 1, characterised in that the refrigerant is carbon dioxide ($CO_2$).

3. A refrigeration system having a closed circulating circuit according to claim 1, characterised in that in association with the circulating circuit there is provided at least one pressure relief valve (20) which releases refrigerant when the saturation pressure exceeds the maximum working pressure of the circulating circuit.

4. A refrigeration system having a closed circulating circuit according to claim 1, characterised in that the connections between the insulated container (1) and the circuits to the peripheral components in the circulating circuit are provided with manual or automatic valves (13) designed to close before the saturation pressure exceeds the maximum working pressure in the whole of or parts of the circuits.

5. A refrigeration system having a closed circulating circuit according to claim 4, characterised in that there are provided check valves (15) in connection with the manual or automatic valves, which check valves (15) allow vaporised refrigerant only to enter the insulated container from the other components in the circuits.

6. A refrigeration system having a closed circulating circuit according to claim 1, characterised in that the insulated container (1) forms a part of a circulating circuit as a low pressure container.

7. A refrigeration system having a closed circulating circuit according to claim 1, characterised in that the insulated container (1) forms a part of the circulating circuit as a fluid container where the refrigerant is used as a secondary medium.

8. A refrigeration system having a closed circulating circuit according to claim 1, characterised in that there is provided a valve (40), which valve (40) allows vaporised refrigerant to enter the compressor (6) from the insulated container (1) at controlled pressure after the valve (40) in order to obtain a controlled fall in pressure in the insulated container (1) after an increase in pressure in the same insulated container (1) above the maximum working pressure in the circuits.

9. A refrigeration system having a closed circulating circuit according to claim 1, characterised in that there is provided a valve (41), which valve (41) allows vaporised refrigerant to enter the condenser (3) from the insulated container (1) at controlled pressure after the valves (41) and via condensation in the condenser (3) to obtain a controlled fall in pressure in the insulated container (1) after an increase in pressure in the same insulated container (1) above the maximum working pressure in the circuits.

10. A refrigeration system having a closed circulating circuit according to claim 1, characterised in that there is necessary volume in the container (50) or in the condenser (3) or in the pipe section between condenser (3) and pipe section (7) to accumulate condensed refrigerant during a controlled fall in pressure in the insulated tank (1) after an increase in pressure in the same insulated container (1) above the maximum working pressure in the circuits.

* * * * *